US007862414B2

(12) United States Patent
Doaga et al.

(10) Patent No.: US 7,862,414 B2
(45) Date of Patent: Jan. 4, 2011

(54) GOLF COURSE COMMUNICATION SYSTEM AND METHOD

(75) Inventors: Alexandru C. Doaga, Richmond (CA); Robert C. Silzer, Sr., Surrey (CA)

(73) Assignee: GPS Industries, LLC, Sarasota, FL (US)

( * ) Notice: Subject to any disclaimer, the term of this patent is extended or adjusted under 35 U.S.C. 154(b) by 1733 days.

(21) Appl. No.: 10/767,407

(22) Filed: Jan. 29, 2004

(65) Prior Publication Data

US 2005/0181883 A1 Aug. 18, 2005

(51) Int. Cl.
*G06F 17/00* (2006.01)

(52) U.S. Cl. ..... 463/1; 463/42

(58) Field of Classification Search ..... 463/3, 463/1, 40–42, 47; 473/131, 407; 273/459–460
See application file for complete search history.

(56) References Cited

U.S. PATENT DOCUMENTS

| | | | | |
|---|---|---|---|---|
| 5,319,548 | A * | 6/1994 | Germain | 700/92 |
| 5,772,534 | A * | 6/1998 | Dudley | 473/407 |
| 6,062,991 | A | 5/2000 | Moriarty et al. | |
| 6,525,690 | B2 | 2/2003 | Rudow et al. | |
| 6,763,236 | B2 * | 7/2004 | Siren | 455/450 |
| 2002/0072815 | A1 | 6/2002 | McDonough et al. | |

* cited by examiner

*Primary Examiner*—Dmitry Suhol
*Assistant Examiner*—Robert Mosser
(74) *Attorney, Agent, or Firm*—The Morris Law Firm, PC; Paula Morris

(57) ABSTRACT

A golf course (10) having a plurality of wireless access points (18) disposed within or near the outer periphery (11) of that golf course can offer communications regarding golf course infrastructure information as well as supporting subscriber communications of various kinds. Such communications can comprise, for example, data packet communications. Pursuant to one embodiment the subscriber communications can include Internet access.

22 Claims, 3 Drawing Sheets

GOLF COURSE COMMUNICATION SYSTEM AND METHOD

TECHNICAL FIELD

This invention relates generally to wireless golf course communication systems.

BACKGROUND

Those skilled in the art are aware of prior use of wireless communications to facilitate golf course operations (including golf course maintenance, security, and general operations). Such systems typically comprise two-way walkie-talkie styled communications that may, or may not, be repeater facilitated.

In more recent times, some golf courses utilize wireless communication systems that can support data traffic in addition to voice communications. Such data-bearing capability can be used to support various operational activities for a corresponding golf course. Furthermore, such capabilities can directly benefit golf course patrons as well as employees and contractors. For example, in addition to relaying golf course infrastructure information of importance to an employee (such as information regarding work schedules, tournament progress, and the like), such a system can provide infrastructure information of value to golfers themselves (such as score information, hole information, and the like).

For various reasons such golf course wireless communications systems tend to permit only authorized access (and often only in conjunction with a specialized transceiver that is generally available only from the golf course itself). Such security tends to ensure both the availability of the system for necessary communications and the integrity of data being borne thereby. Unfortunately, such an approach tends to render such a communication system in isolation. Even when system resources might support expanded usage such usage cannot be readily or predictably facilitated. As a result, such systems tend to represent a relatively costly investment for a golf course with only a limited return on investment opportunity.

BRIEF DESCRIPTION OF THE DRAWINGS

The above needs are at least partially met through provision of the golf course communication system and method described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are sometimes not depicted in order to facilitate a less obstructed view of these various embodiments of the present invention.

DETAILED DESCRIPTION

Generally speaking, pursuant to these various embodiments, wireless communication resources are provided for at least a substantial portion of a golf course with a first part (but not all) of such wireless communication resources being dedicated to support golf course infrastructure communications. Another part of such wireless communication resources are then available for use to support subscriber communications.

For example, pursuant to one embodiment, such subscriber communications can comprise data-based communications, such as but not limited to packet data formatted voice or data messages. Pursuant to one approach, this can include two-way Internet access. Such subscriber communications can benefit previously authorized subscribers including but not limited to golf course visitors, golf course club members, residents of nearby homes, condominiums, or apartments, and guests of proximate hotels, inns, motels, cottages, cabins, camping facilities, resorts, and the like.

To facilitate such an approach, a local area network can be comprised of a plurality of wireless access points that are disposed about a golf course. That local area network can then support, in a preferred approach, a wireless communications protocol that facilitates both golf course infrastructure information (including automatically update infrastructure information) on the one hand and subscriber communications on the other hand. Depending upon the needs of a given setting, it is not necessary that both services be simultaneously available to all (or even any) network participants.

Figure 1:
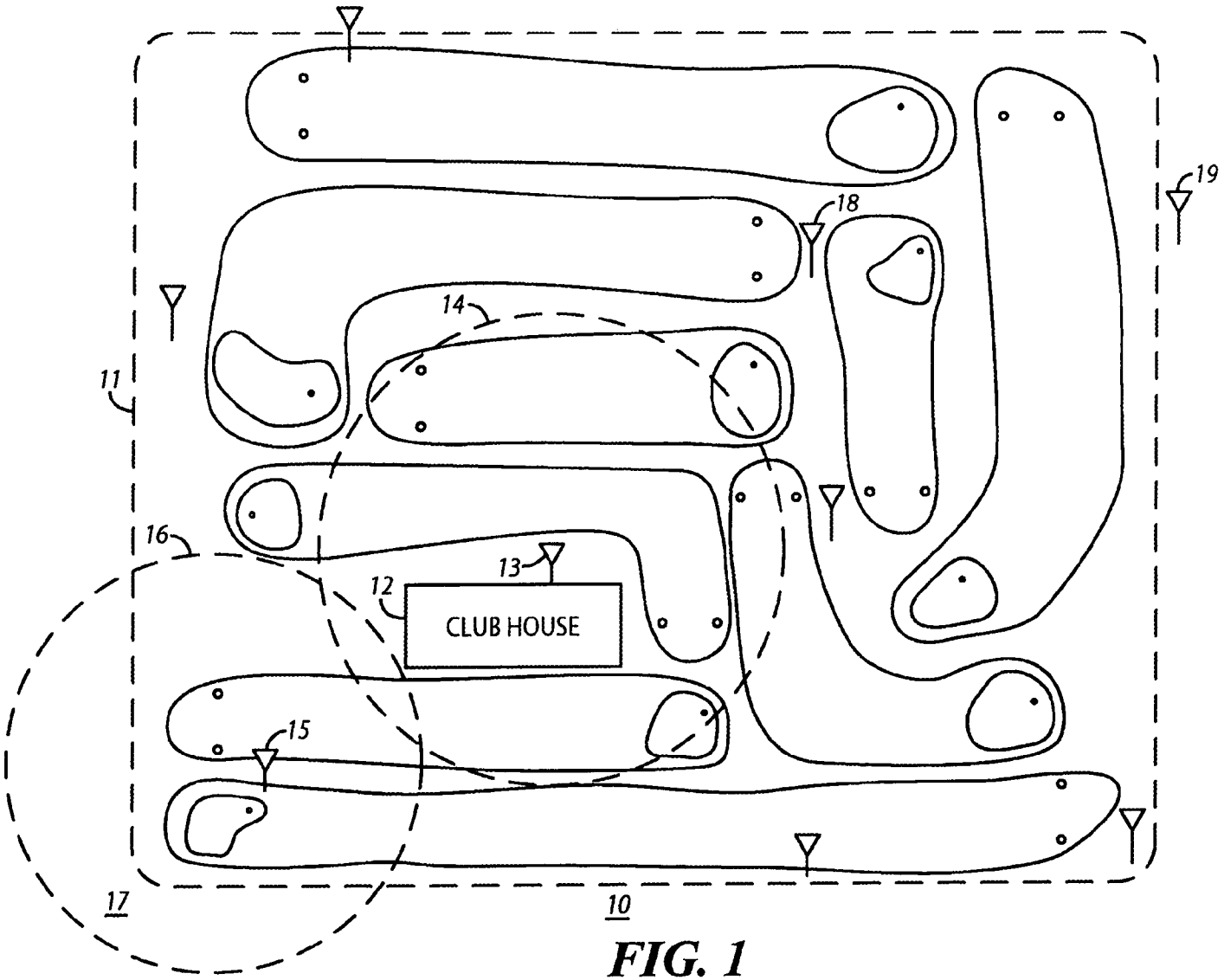
FIG. 1 comprises a top plan schematic view of a golf course as configured in accordance with an embodiment of the invention.

Referring now to the drawings, and in particular to FIG. 1, a typical golf course 10 will comprise one or more holes (each hole being comprised of a tee area, a fairway, and a green and pin (along with various and sundry obstacles, bunkers, traps, and the like) that are arranged within a periphery 11 that defines the boundaries of the golf course 10. The embodiment illustrated depicts a nine hole golf course, but it will be readily understood that these teachings are readily applicable to golf courses of various sizes and designs including both larger and smaller golf courses. The infrastructure of such a golf course 10 will typically include at least one central or main building comprising a club house 12. Such a club house 12 can provide facilities for a so-called pro shop, a dining and/or libations area, meeting areas, maintenance areas, and so forth. Other buildings and man-made structures can also be provided where and as needed or appropriate to the needs of a given golf course embodiment.

Pursuant to these embodiments, a plurality of wireless access points 18 are disposed about the golf course. In a typical embodiment, substantially all of the plurality of wireless access points are disposed within the outer periphery 11 of the golf course 10. If desired, however, one or more wireless access points can be disposed to the exterior of this outer periphery 11 as illustrated here by the wireless access point bearing the reference numeral 19.

In general, these wireless access points 18 preferably support an appropriate protocol and modulation to permit adequate facilitation of the desired communication load and traffic. For example, 802.11 (a), (b, or (g) or a combination thereof compatible wireless communications are readily employed in such a scenario. Such protocols, and the platforms that support them, are well understood in the art and will not be related here in further detail for the sake of brevity and the preservation of clarity except where particularly useful to this description.

If desired, a single wireless access point could be used to provide communications access for the entire golf course 10.

In a preferred embodiment, however, a plurality of lower power access points are conveniently and inexpensively deployed for these purposes. For example, the club house 12 (or such other building, shelter, or location of choice) can house a first wireless access point 13 that provides wireless communications within a first corresponding zone of coverage 14. A different portion of the golf course 10 can meanwhile be serviced by a second wireless access point 15 having a second corresponding zone of coverage 16. It should be noted that, not untypically, such a deployment will result in at least one or more of these wireless access points, such as the latter mentioned access point 15, having a corresponding zone of coverage 16 that includes at least one portion 17 that is external to the golf course 10. When this occurs, by default or by design, such an external zone 17 may well comprise a residential area or other area that includes, supports, or attracts various human presence or activity including behaviors that will benefit from two-way wireless communications such as Internet access.

Pursuant to these embodiments, a portion, but not all, of the capacity of the resultant wireless communication resource is dedicated to support infrastructure communications for the golf course 10 itself Another part of that resource is then used to support subscriber communications (for example, for subscribers who reside within an external zone 17 that is adjacent to the golf course 10). Such apportionment can be achieved in a variety of ways and the precise allocation vehicle will depend to some extent upon the communication protocol and/or modulation being used as the resource itself.

As one illustrative example, when the resource comprises a frequency divided resource, one or more frequencies can be reserved for the exclusive use of golf course infrastructure communications with other frequencies being used either exclusively for subscriber communications or on a shared basis for both subscribers and infrastructure needs. As another illustrative example, when the resource comprises time multiplexed communication opportunities, one or more of those temporally-based communication opportunities can be reserved for exclusive infrastructure needs with other slots, fields, or the like being used for subscriber and/or shared purposes. Much the same can also be done when using a code divided communication resource.

Similar strategies can be employed when the communication resource comprises a packet data vehicle such as 802.11 (a), (b), or (g) or a combination thereof That is, some portion of the available packet data opportunity can be reserved for required infrastructure communications with a remaining portion being available for subscriber communications. Pursuant to one approach, either kind of service can be provided without restriction. Then, if and when a given infrastructure communication requires resource availability, an existing subscriber communication can be temporarily halted, buffered, or delayed as necessary to provide access opportunity for the infrastructure communication.

These examples are intended to be illustrative only and are not to be taken as an exhaustive listing of all possible ways by which a given communication resource can be parsed to permit bifurcated service as between golf course infrastructure communications on the one hand and subscriber communications on the other. Those skilled in the art will recognize that essentially any sufficiently flexible resource allocation, scheduling, and/or parsing mechanism, whether presently known or hereafter developed, can be successfully employed to achieve these benefits.

So configured, the communication needs of various subscribers can be satisfied while also ensuring the communication needs of a given golf course. These subscribers can often be accommodated without requiring a particular upgrade to the wireless access point deployment scheme itself. By accessing a usage fee to authorized subscribers in exchange for such access, the golf course can realize a supplemental revenue stream and thereby enhance its likelihood of remaining a financially viable enterprise.

Figure 2:
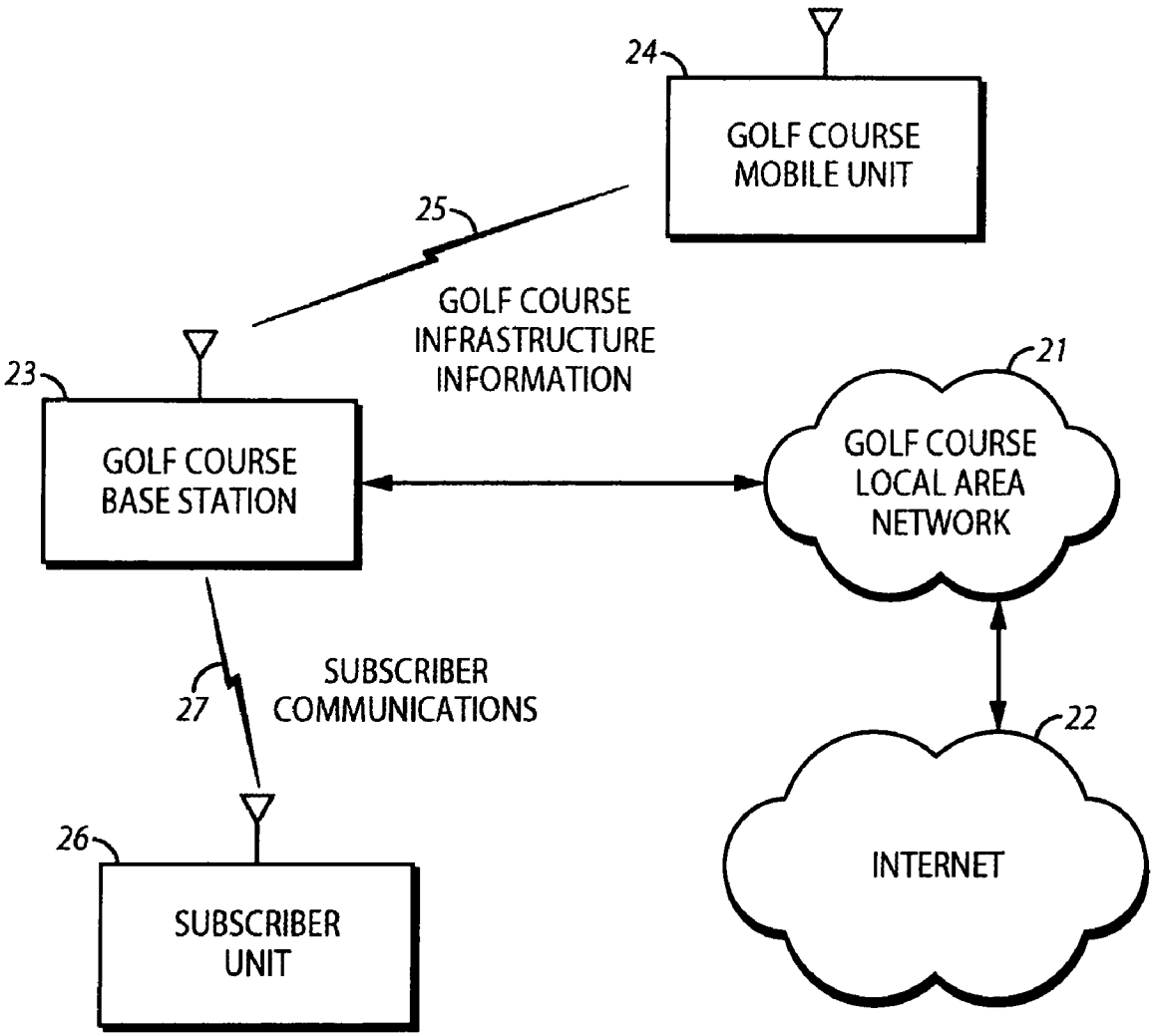
FIG. 2 comprises a block diagram as configured in accordance with an embodiment of the invention.

Referring now to FIG. 2, a golf course local area network 21 can be comprised of various components and elements that are networked together in any satisfactory manner. These elements can include computers, printers, scanners, routers, and so forth as is well understood in the art. In one embodiment this local area network 21 also couples to one or more extranets such as the Internet 22. So configured, various of the local area network elements have access to other elements, such as remote servers, via this extranet connection. Pursuant to a preferred approach, this system includes at least one golf course base station 23 that serves as a wireless access point (only one such base station is depicted in FIG. 2 for the sake of clarity, but in a preferred embodiment there will tend to be a plurality of such base stations) for the golf course local area network 21.

This golf course base station 23 supports wireless communications with one or more golf course mobile units 24. The latter can comprise, for example, hand held or golf cart mounted two-way or one-way units that support voice and/or data communications. In particular, these communications comprise golf course infrastructure information. Such communications will typically comprise messages interacting with one or more elements of the golf course local area network 21 (though Internet 22 interaction may also be supported as necessary or appropriate). Such information can comprise any information that relates to real time and/or planned or anticipated data or instructions as pertain to the status, operations, or maintenance of the golf course. Such information can include, but is not limited to, such information as:

- pin placement information (including present, historical, and/or planned placement);
- edible consumables ordering information (including available menu items, order making and taking support, order status, and the like);
- merchandise ordering information (including the purchase or rental of various items of golfing equipment and supplies or souvenirs);
- score information (including historical or present score information for specific individuals, teams, tournament play, players on other golf courses, and the like); and/or
- scorecard printing information (including score submission or confirmation messages to facilitate printing of a given scorecard at, for example, a club house or other location of choice).

It will be well understood that such golf course infrastructure information 25 can comprise user-initiated transmissions and/or automated transmissions. To illustrate, and as to the latter, pin placement information that comprises relatively new pin placement information can be automatically broadcast pursuant to a first broadcasting schedule while pin placement information that is relatively older can be automatically broadcast pursuant to a different second broadcasting schedule. For example, the first broadcasting schedule can comprise transmission of new pin placement information about every 60 seconds for about five minutes and the second broadcasting schedule can comprise transmission of old pin placement information about once every ten minutes.

Pursuant to a preferred approach, this golf course base station 23 also serves to support wireless subscriber communications 27 with one or more subscriber units 26. In one embodiment these subscriber communications 27 comprise packet data subscriber communications and the golf course base station 23 serves in many instances as a wireless access point to provide subscriber unit access to a data network such as the Internet 22. These subscriber unit communications can have little or nothing to do with the operation of the golf course itself Instead, these communications can instead pertain completely to the interests and needs of the subscribers themselves. For example, a person who resides in a home that is adjacent such a golf course can use the golf course wireless access opportunity to interact wirelessly with the Internet to support their personal or business packet data communications needs.

Figure 3:
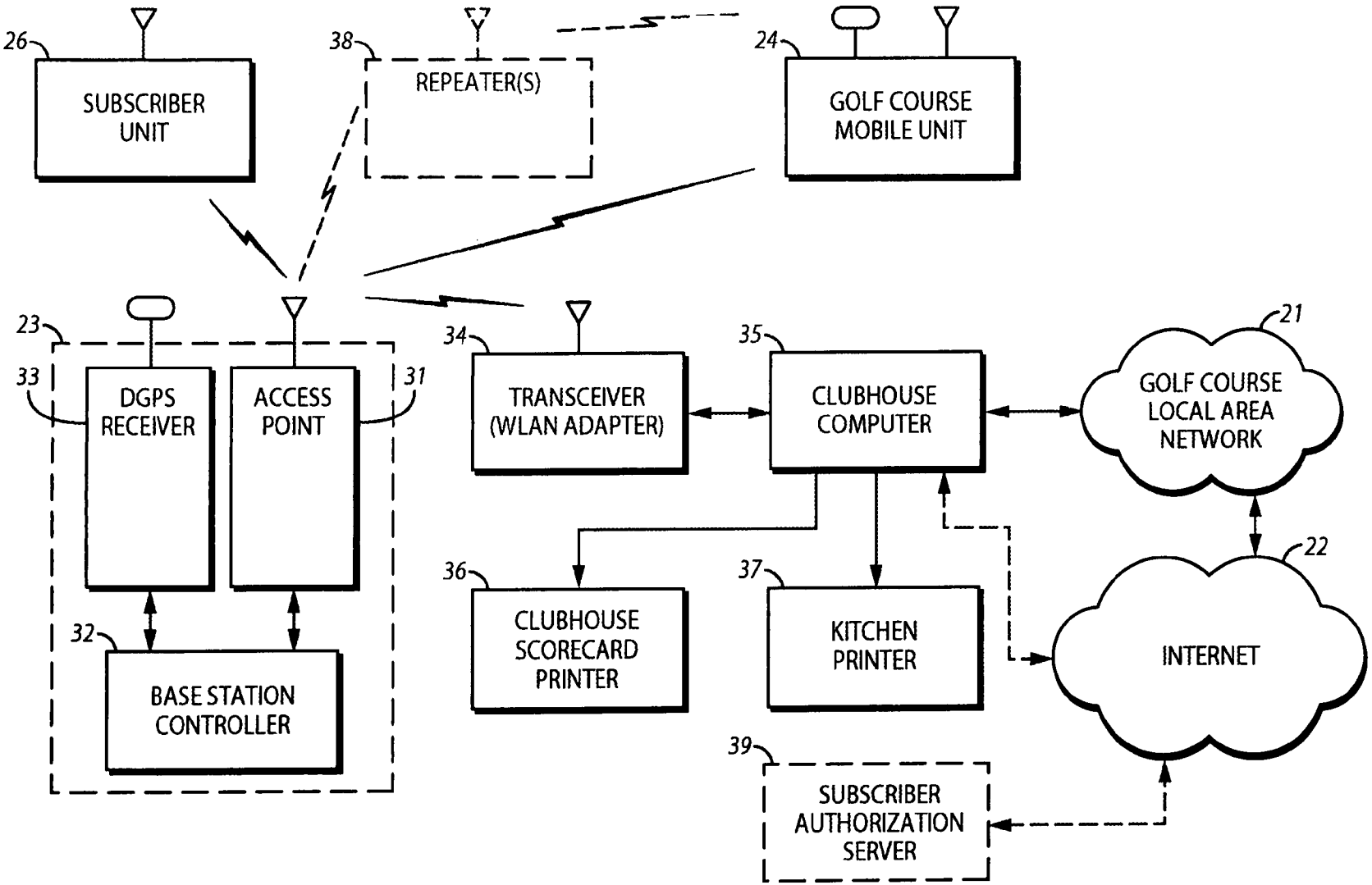
FIG. 3 comprises a detailed block diagram as configured in accordance with various embodiments of the invention.

A more detailed illustrative embodiment will now be presented with reference to FIG. 3. A golf course remotely positioned base station 23 can be comprised of a wireless access point 31 (such as an access point as offered by YDI Wireless, Inc.). Such an access point will readily accommodate, for example, 802.11(a), (b), (g) or a combination of these protocols. In this embodiment, the base station 23 also comprises a differential global position satellite receiver 33 (such as a BAE Systems Starbox GPS receiver) that receives GPS signals from orbiting global positioning satellites as is well understood in the art. A base station controller 32 operably couples to and aids in controlling the operation of the access point 31 and the DGPS receiver 33. In addition to the base station 23, there can be one or more wireless repeaters 38 (such as Proxim repeaters) deployed with respect to a given golf course to provide adequate coverage and provision of corresponding services. Those skilled in the art will also recognize that such repeaters can differ from one another with respect to number of radios, antenna configuration, and/or antenna steering as well as with respect to average radiated power to accommodate various coverage needs and challenges.

Such a base station 23 and repeaters 38 communicate via an appropriate link to a computer 35 (in this case, a club house computer; i.e., a computer such as a personal computer that is disposed at the club house for the golf course). In this embodiment, this link comprises a radio frequency channel supported by a transceiver 34 that also supports the wireless protocol used by the base station 23 to transmit its protocol and user data to the computer 35. A YDI WLAN adapter can be used to realize this embodiment. So configured, the base station 23 and the repeaters(s) 38 can readily network with the club house computer 35 to effect both subscriber communications and transmission and/or reception of golf course infrastructure information.

Such elements as have just been described are well known in the art. Therefore, additional details regarding such elements will not be presented for the sake of clarity and the pursuit of brevity.

The club house computer 35 in turn operably couples to the golf course local area network 21 and/or an extranet such as the Internet 22 (with the latter coupling being achieved either via the local area network 21 and/or via a more direct connection as may be available to the computer 35) (those skilled in the art will recognize that the computer 35 in fact will likely comprise a part of the golf course local area network 21 but these two elements have been shown in discrete fashion here for purposes of explanation).

Depending upon the needs of a given application, the club house computer 35 can couple to specific elements such as a club house scorecard printer 36 (where scorecards for playing golfers can be printed and then provided to the golfers and/or retained for record keeping purposes) and/or a kitchen printer 37 (where orders as received from golfers via their two-way data or voice connections can be printed and then acted upon accordingly). Such elements can couple directly to the club house computer 35 as illustrated or can comprise parts of the local area network 21 that are accessible via that network 21 (with such architectural choices being well understood in the art).

So configured, golf course mobile units 24 can readily communicate with the base station(s) 23 via the supported radio frequency communication link to gain access, via the club house computer 35, to desired services such as scorecard printing or food ordering. This same link can also be used to support other infrastructure needs as well, including tournament announcements, score updates, and the like. As another example, when the golf course mobile units 24 are GPS capable (to permit, for example, range calculation from a present position of a golfer to a given pin), differential GPS correction factors as calculated at a GPS-capable base station 23 such as the one depicted and/or at the club house computer 35 (or such other calculation platform as may be available locally or remotely) can be provided via this link to the golf course mobile unit 24 to permit more accurate range calculations in accord with well understood GPS technology and methodology.

Also as configured, these same base stations can service the communication needs of one or more subscriber units 26. In particular, the data packet communication needs of a given subscriber unit can be facilitated using the same link via the base station access point platform 31 to gain access to, for example, the Internet 22. Such a subscriber unit 26 may have no access to golf course infrastructure information but may have essentially unfettered access to the resources of the Internet 22 including email, the World Wide Web, user group sites, file transfer sites, and so forth.

In general, the golf course operator will likely wish to control such access by a subscriber unit. To facilitate such control, an optional subscriber authorization server 39, which is preferably located on the Internet (external to the golf course) and that can provide services to all the golf courses provided with such a system, is used to maintain a list of authorized subscribers and/or to otherwise evaluate and authorize usage of such a system by any given subscriber. Such functionality is accessed via the Internet 22 in a preferred embodiment but local access can be provided if desired. In addition to effecting authorization, such a server (or another platform if so desired) can also effect a billing system of choice. For example, such a server can maintain records regarding access and usage to permit billing on a corresponding basis. Or, such a server can maintain payment records to ensure that a given subscriber remains current with respect to their payment obligations.

Such a system will well serve a wide variety of communication needs that benefit the operation of a golf course while also providing an opportunity to derive additional income based upon generalized Internet access as accorded to subscribing entities. Such benefits can be attained without requiring a significant corollary incremental investment as the communication system that is adequate to the needs of one of these uses will tend to be adequate to the needs of the other use as well.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A communications system comprising:

a local area network that comprises a plurality of wireless access points disposed about a golf course;

a wireless communications protocol operably supported by the plurality of wireless access points, wherein the wireless communications protocol supports:

automatically updating golf course infrastructure information; and subscriber communications.

2. The communications system of claim 1 wherein substantially all of the plurality of wireless access points are disposed within an outer periphery of the golf course.

3. The communications system of claim 1 wherein the plurality of wireless access points are arranged and configured to provide wireless communication coverage to at least a substantial majority of the golf course.

4. The communications system of claim 3 wherein the plurality of wireless access points are further arranged and configured to provide wireless communication coverage to at least one zone that is external to the golf course.

5. The communications system of claim 4 wherein the at least one zone comprises a residential area.

6. The communications system of claim 1 wherein the golf course comprises at least a nine hole golf course.

7. The communications system of claim 1 wherein the golf course infrastructure information comprises at least one of:

pin placement information;

edible consumables ordering information;

merchandise ordering information;

score information;

scorecard printing information.

8. The communications system of claim 7 wherein the pin placement information comprises substantially current pin placement information.

9. The communications system of claim 1 wherein automatically updating golf course infrastructure information comprises:

automatically broadcasting pin placement information pursuant to a first broadcasting schedule when providing new pin placement information;

automatically broadcasting pin placement information pursuant to a second broadcasting schedule when providing old pin placement information.

10. The communications system of claim 1 wherein the subscriber communications comprise packet data subscriber communications.

11. The communications system of claim 10 and further comprising a subscriber authorization server that is operably coupled to the local area network.

12. The communications system of claim 11 wherein the subscriber authorization server comprises authorization means for determining that a given subscriber is authorized to use the local area network and for permitting the given subscriber to conduct a wireless communication via the local area network.

13. The communications system of claim 1 wherein the subscriber communications comprise access to a data network.

14. The communications system of claim 13 wherein the data network comprises the Internet.

15. A method of facilitating various wireless communications proximal to a golf course, comprising:

providing wireless communication resources for at least a substantial portion of the golf course;

dedicating a first part, but not all, of the wireless communication resources to support golf course infrastructure communications;

using part of the wireless communication resources to support subscriber communications.

16. The method of claim 15 wherein providing wireless communication resources for at least a substantial portion of the golf course further comprises providing wireless communication resources for at least a substantial portion of the golf course and at least a first zone that is external to the golf course.

17. The method of claim 16 wherein providing wireless communication resources for at least a substantial portion of the golf course and at least a first zone that is external to the golf course further comprises providing wireless communication resources for at least a substantial portion of the golf course and at least a first zone that is external to the golf course and that comprises a residential area.

18. The method of claim 15 wherein providing wireless communication resources further comprises providing a plurality of wireless access points.

19. The method of claim 18 wherein providing a plurality of wireless access points further comprises providing a plurality of wireless packet data access points.

20. The method of claim 15 wherein dedicating a first part, but not all, of the wireless communication resources to support golf course infrastructure communications further comprises dedicating a first part, but not all, of the wireless communication resources to support golf course infrastructure communications regarding current pin placement information.

21. The method of claim 20 wherein using part of the wireless communication resources to support subscriber communications further comprises using part of the wireless communication resources to support subscriber communications for previously authorized subscribers.

22. The method of claim 21 and further comprising assessing a usage fee to the authorized subscribers.

* * * * *